US006125768A

United States Patent [19]

Kurnik

[11] Patent Number: 6,125,768

[45] Date of Patent: Oct. 3, 2000

[54] DOOR SYSTEM FOR TRANSIT VEHICLE

[75] Inventor: Ziggy Kurnik, Elk Grove Village, Ill.

[73] Assignee: Westinghouse Air Brake Company, Wilmerding, Pa.

[21] Appl. No.: 09/172,394

[22] Filed: Oct. 14, 1998

[51] Int. Cl.[7] ..... B61D 19/00

[52] U.S. Cl. ..... 105/343; 49/108; 49/110; 49/111; 296/146.4

[58] Field of Search ..... 105/343; 296/146.4; 49/108, 109, 110, 111, 122, 141, 340, 379

[56] References Cited

U.S. PATENT DOCUMENTS

| | | | |
|---|---|---|---|
| 2,893,506 | 7/1959 | Daugirdas | 49/110 |
| 3,462,881 | 8/1969 | Lynn et al. | 49/111 |
| 3,948,000 | 4/1976 | Pedersen | 49/340 |
| 4,087,939 | 5/1978 | Elguindy et al. | 49/122 |
| 4,346,533 | 8/1982 | Britzke et al. | 49/110 |
| 4,375,140 | 3/1983 | Blair et al. | 49/108 |
| 4,454,685 | 6/1984 | Van Der Sloot et al. | 49/110 |
| 4,653,227 | 3/1987 | Condon et al. | 49/110 |
| 5,332,279 | 7/1994 | Golemis et al. | 296/146.4 |

*Primary Examiner*—Stephen Avila
*Assistant Examiner*—Lars A. Olson
*Attorney, Agent, or Firm*—James Ray & Associates

[57] ABSTRACT

A biparting transit vehicle door system operator. The operator includes a base for attachment to the mass transit vehicle and a motive power source connected to a transmission having an output power shaft. Such operator further includes a teeter plate having a shaft engaging portion for engaging the shaft. The shaft has a teeter plate engaging portion for engaging the operator teeter plate. A thrust bearing is in mechanical contact with a hub portion of the teeter plate and a spring is in mechanical contact with the thrust bearing to exert a first axial thrust thereon. The thrust bearing communicating the first axial thrust to the teeter plate so that the shaft engaging portion of the teeter plate engages the teeter plate engaging portion of the shaft. The operator includes a release member having mechanical contact with the hub portion of the teeter plate for exerting a second axial thrust on the teeter plate. The second axial thrust being opposed to the first axial thrust so that the teeter plate may be disengaged from the shaft by the release member. A pair of drive rod pivots are attached to the teeter plate. Such pair of drive rod pivots are connected to a pair of drive rods for opening and closing the pair of biparting doors.

19 Claims, 7 Drawing Sheets

FIG. 6
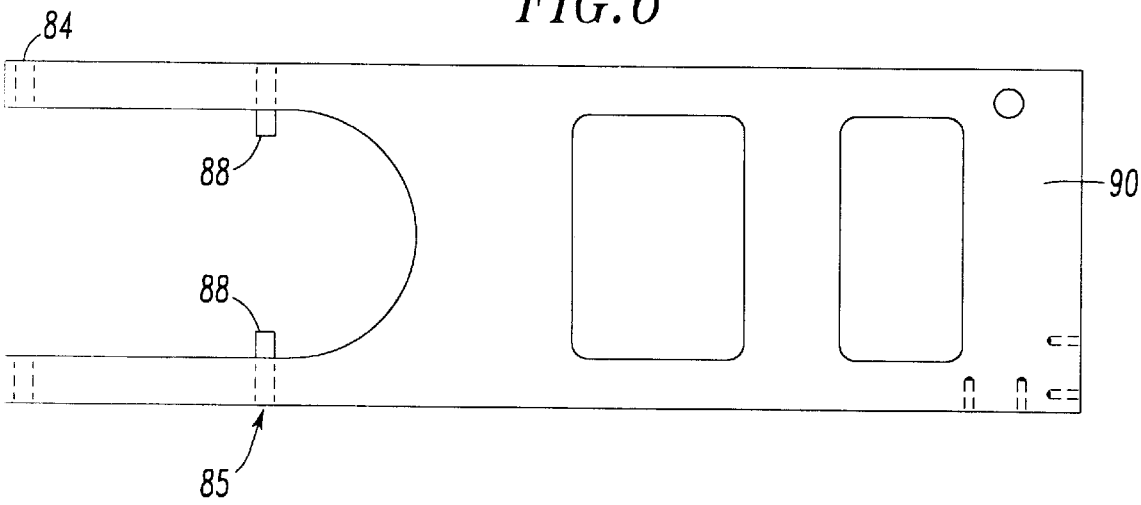
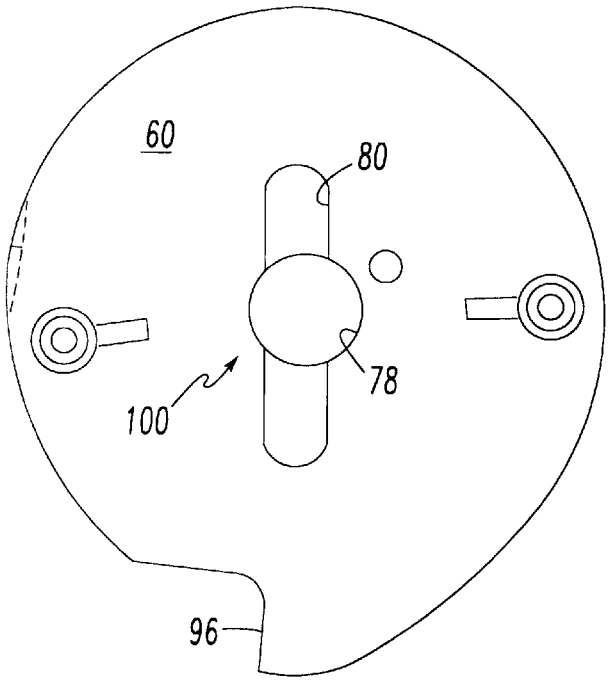
FIG. 7A
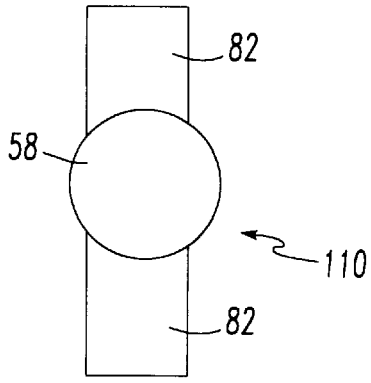
FIG. 7B

DOOR SYSTEM FOR TRANSIT VEHICLE

FIELD OF THE INVENTION

The present invention relates, in general, to an operator for a passenger transit type vehicle door system and, more particularly, the present invention relates to an operator for biparting slide glide and swing type door systems for passenger transit vehicles.

BACKGROUND OF THE INVENTION

The design of passenger transit vehicle doors is crucial for the safety of the travelling public. As is well known in the transit industry, these doors must function in a relatively hostile environment which at least include heavy usage, temperature extremes, vibration and acceleration loads. They must open and close quickly and they must meet conflicting requirements such as being securely closed when they are in the closed position and yet they must be capable of being opened manually to provide emergency egress of passengers.

One known prior art system is described in U.S. Pat. No. 5,332,279, which is entitled POWER DOOR OPERATOR FOR MULTI-PASSENGER MASS TRANSIT VEHICLES. The teachings of the referenced patent are incorporated herein by reference thereto.

The operator described in the referenced patent has an electrical motor attached to a transmission. The transmission has an output power shaft which engages drive arms connected to rods which open and close the doors. A spring loaded clutch plate includes a pair of pins engaging a collar attached to the drive arms to maintain the drive arms in engagement with the output power shaft of the transmission.

To provide emergency egress when the doors are closed, a plunger pushes the clutch plate to disengage the drive arms from the transmission output power shaft so that the doors can be opened. Difficulties have been experienced with this prior art design because the pin and collar combination tends to bind if it is not perfectly aligned. Additionally, when the doors are opened and closed, the pins slide in a groove in the collar and experience excessive wear. This is because the pins continually exert a force on the collar to bias the drive arms into engagement with the output power shaft of the transmission.

SUMMARY OF THE INVENTION

In a first embodiment, the present invention provides an operator for a mass transit vehicle door system having a pair of biparting doors. It includes a base for attachment to the mass transit vehicle and a motive power source. It also includes a transmission connected to receive motive power from the motive power source. Such transmission includes a transmission output power shaft. Either the motive power source or the transmission is attached to the base. The operator further includes a teeter plate having a shaft engaging portion for engaging the shaft. The shaft has a teeter plate engaging portion for engaging the operator teeter plate. A thrust bearing is in mechanical contact with a hub portion of the teeter plate and a spring is in mechanical contact with the thrust bearing to exert a first axial thrust thereon. Such thrust bearing communicating the first axial thrust to the teeter plate so that the shaft engaging portion of the teeter plate engages the teeter plate engaging portion of the shaft. The operator further includes a release member having mechanical contact with the hub portion of the teeter plate for exerting a second axial thrust on the teeter plate. This second axial thrust being opposed to the first axial thrust so that the teeter plate may be disengaged from the shaft by the release member. A pair of drive rod pivots are attached to the teeter plate. The pair of drive rod pivots are connected to a pair of drive rods for opening and closing the pair of biparting doors.

In a second embodiment, the present invention provides a biparting swing door system for a mass transit vehicle. Such biparting swing door system includes an operator which has a base for attachment to the mass transit vehicle and a motive power source. The biparting swing door system, also, includes a transmission which is connected to receive motive power from the motive power source. Such transmission having a transmission output power shaft. Either the motive power source or the transmission is attached to the base. The operator has a teeter plate having a shaft engaging portion for engaging the shaft and the shaft has a teeter plate engaging portion for engaging the teeter plate. A thrust bearing is in mechanical contact with a hub portion of the teeter plate and a spring is in mechanical contact with the thrust bearing to exert a first axial thrust thereon. Such thrust bearing communicating the first axial thrust to the teeter plate so that the shaft engaging portion of the teeter plate engages the teeter plate engaging portion of the shaft. Further, the operator has a release member having mechanical contact with the hub portion of the teeter plate for exerting a second axial thrust on the teeter plate. The second axial thrust being opposed to the first axial thrust so that the teeter plate may be disengaged from the shaft by the release member. A pair of drive rod pivots are attached to the teeter plate and a pair of drive rods are attached to the drive rod pivots. The system includes a pair of biparting swing doors and the drive rods are attached to door drive pivots connected to the biparting swing doors to move the doors between open and closed positions.

In a third embodiment, the instant invention provides a biparting slide glide door system for a mass transit vehicle. This system includes an operator which has a base for attachment to the mass transit vehicle and a motive power source. It also has a transmission connected to receive motive power from the motive power source. The transmission includes a transmission output power shaft. Either the motive power source or the transmission is attached to the base. The operator further includes a teeter plate having a shaft engaging portion for engaging the shaft. The shaft has a teeter plate engaging portion for engaging the teeter plate. A thrust bearing is in mechanical contact with a hub portion of the teeter plate and a spring is in mechanical contact with the thrust bearing to exert a first axial thrust thereon. Such thrust bearing communicating the first axial thrust to the teeter plate so that the shaft engaging portion of the teeter plate engages the teeter plate engaging portion of the shaft. The operator further includes a release member having mechanical contact with the hub portion of the teeter plate for exerting a second axial thrust on the teeter plate. This second axial thrust being opposed to the first axial thrust so that the teeter plate may be disengaged from the shaft by the release member. A pair of drive rod pivots are attached to the teeter plate and a pair of drive rods are attached to the drive rod pivots. The system has a pair of biparting slide glide door panels and the drive rods are attached to door drive pivots connected to the biparting slide glide doors to move the doors between open and closed positions.

OBJECTS OF THE INVENTION

It is, therefore, one of the primary objects of the present invention to provide an operator for biparting passenger transit vehicle doors which may be disengaged so that the doors may be opened.

Another object of the present invention is to provide a transit vehicle door operator having a teeter plate which undergoes less wear than prior art designs.

Still another object of the present invention is to provide a biasing means for a teeter plate in a transit vehicle door system which uses a thrust bearing to reduce wear.

Yet another object of the present invention is to provide a biasing means for a teeter plate in a transit vehicle door system which reduces binding.

A further object of the present invention is to provide a biasing means for a teeter plate in a transit vehicle door system which is highly reliable.

It is an additional object of the present invention to provide a biasing force for a teeter plate in a transit vehicle door system which can be manually overcome to provide emergency egress of passengers.

Still yet another object of the present invention is to provide a biasing means for a teeter plate in a transit vehicle door system which can readily be retrofitted into the prior art system.

An additional object of the present invention is to provide a biparting transit vehicle door system having a stop to control compression of the door seals when the doors are closed.

Another object of the present invention is to provide a biparting transit vehicle door system having an adjustable stop to control compression of the door seals when the doors are closed.

Also, an object of the present invention is to provide a stop to precisely limit the closure of the doors to prevent locking of the drive mechanism.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

BRIEF DESCRIPTION OF THE DRAWINGS

FIG. 6 is a front elevation view of the release member.

FIG. 7A is a front elevation view of the teeter plate.

FIG. 7B is a front elevation view of the end of the transmission output power shaft which shows the teeter plate engaging portion.

Figure 1:
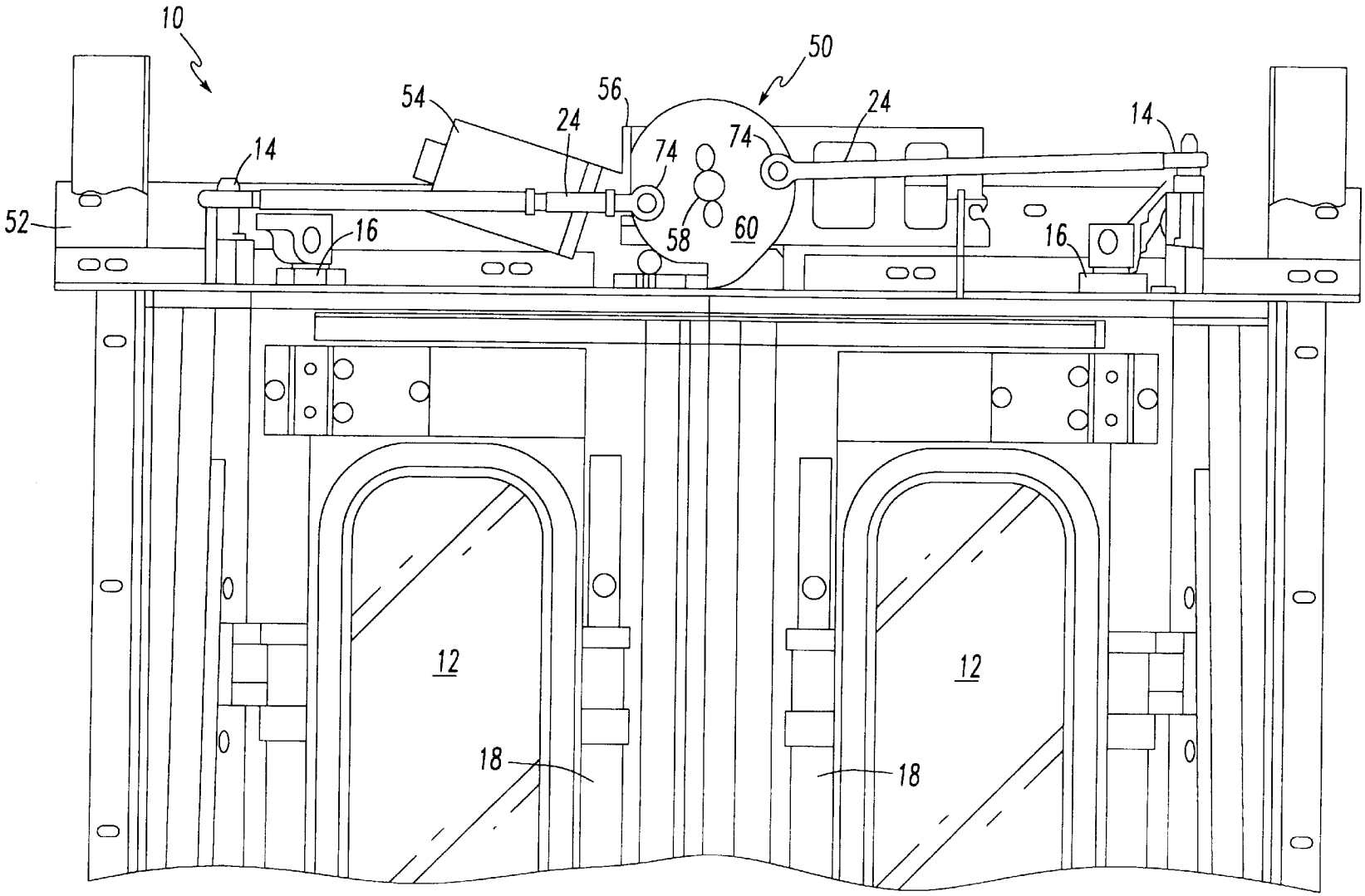
FIG. 1 is a front, elevation view of a biparting swing door system for a passenger transit vehicle according to the present invention.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures for the sake of clarity and understanding of the invention.

Figure 2:
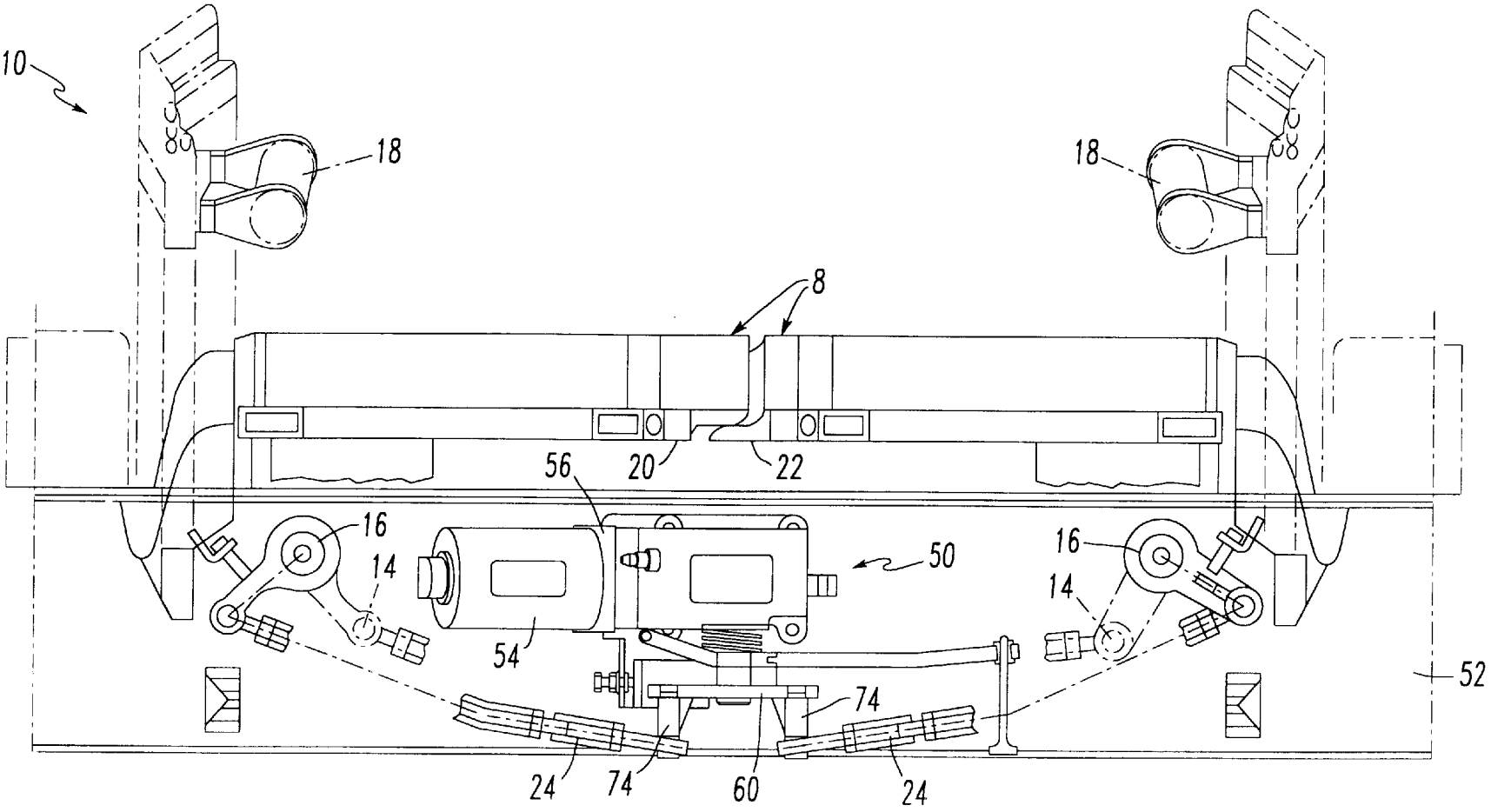
FIG. 2 is a top view of a biparting swing door system for a passenger transit vehicle according to the present invention.

Reference is now made, more particularly, to FIGS. 1 and 2. Illustrated therein is a biparting passenger transit vehicle swing door system, generally designated 10, according to one presently preferred embodiment of the invention.

The swing door system 10 includes an operator, generally designated 50. Operator 50 includes a base 52 and a motive power source 54 which drives a transmission 56. Additional detail with respect to the operator 50 is provided in FIGS. 3, 4A, 4B, 5A, 5B, 6, 7A and 7B.

It is presently preferred that the transmission 56 be attached to base 52. The transmission 56 has an output power shaft 58 which engages a teeter plate 60. A pair of drive rods 24 are attached to drive rod pivots 74 disposed on such teeter plate 60. Such drive rods 24 are attached to door drive pivots 14 to open and close the doors 12. Doors 12 are shown closed in FIGS. 1 and 2, and their open positions are shown in phantom. Touch bars 18, which may be used by a passenger to open doors 12 when the vehicle (not shown) is stopped, are provided. The doors 12 are pivoted about door pivots 16 and, preferably, such doors 12 are provided with door seals 20 and 22.

Figure 8:
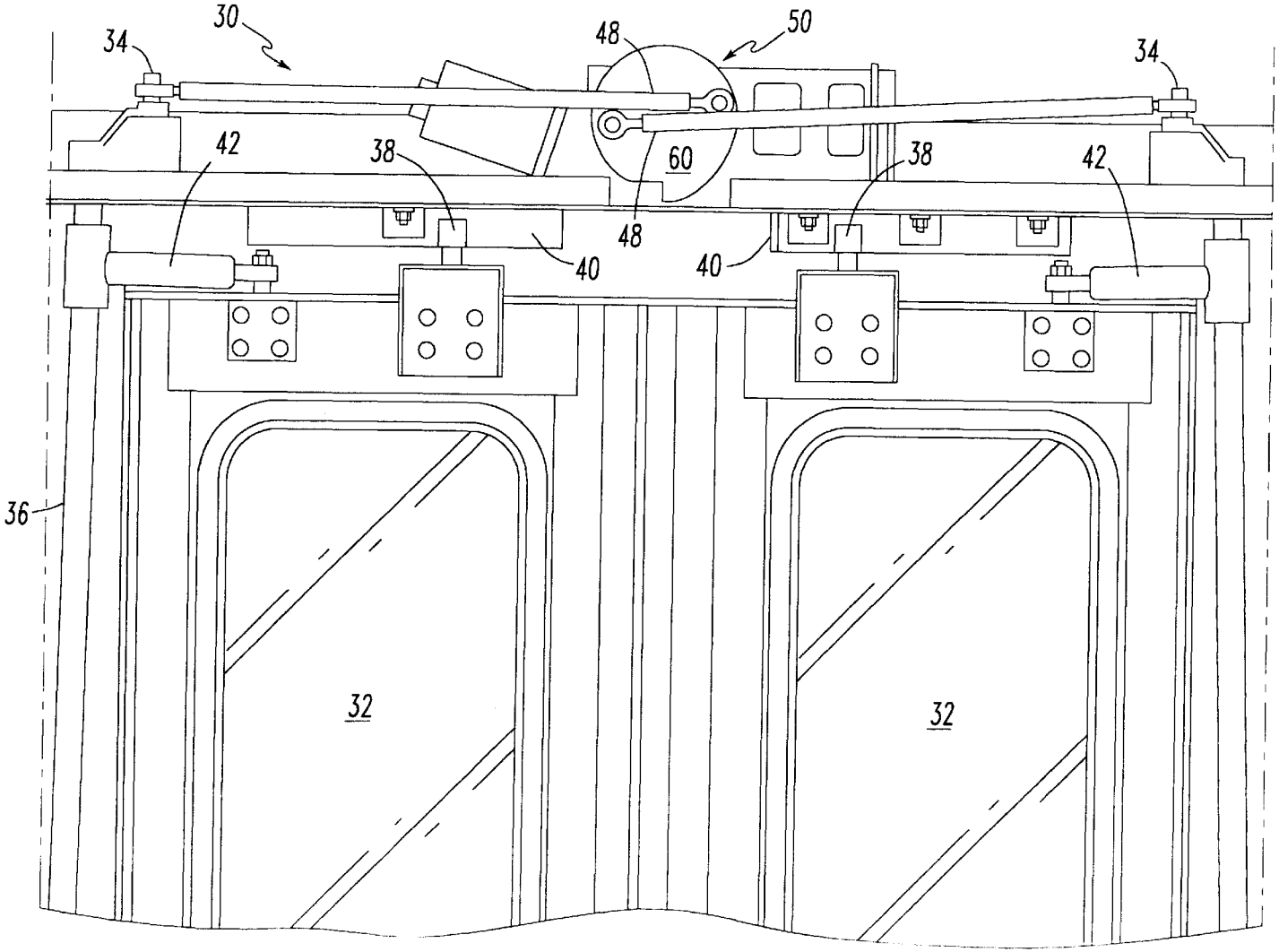
FIG. 8 is a front elevation view of a biparting slide glide passenger transit vehicle door system according to this invention.
Figure 9:
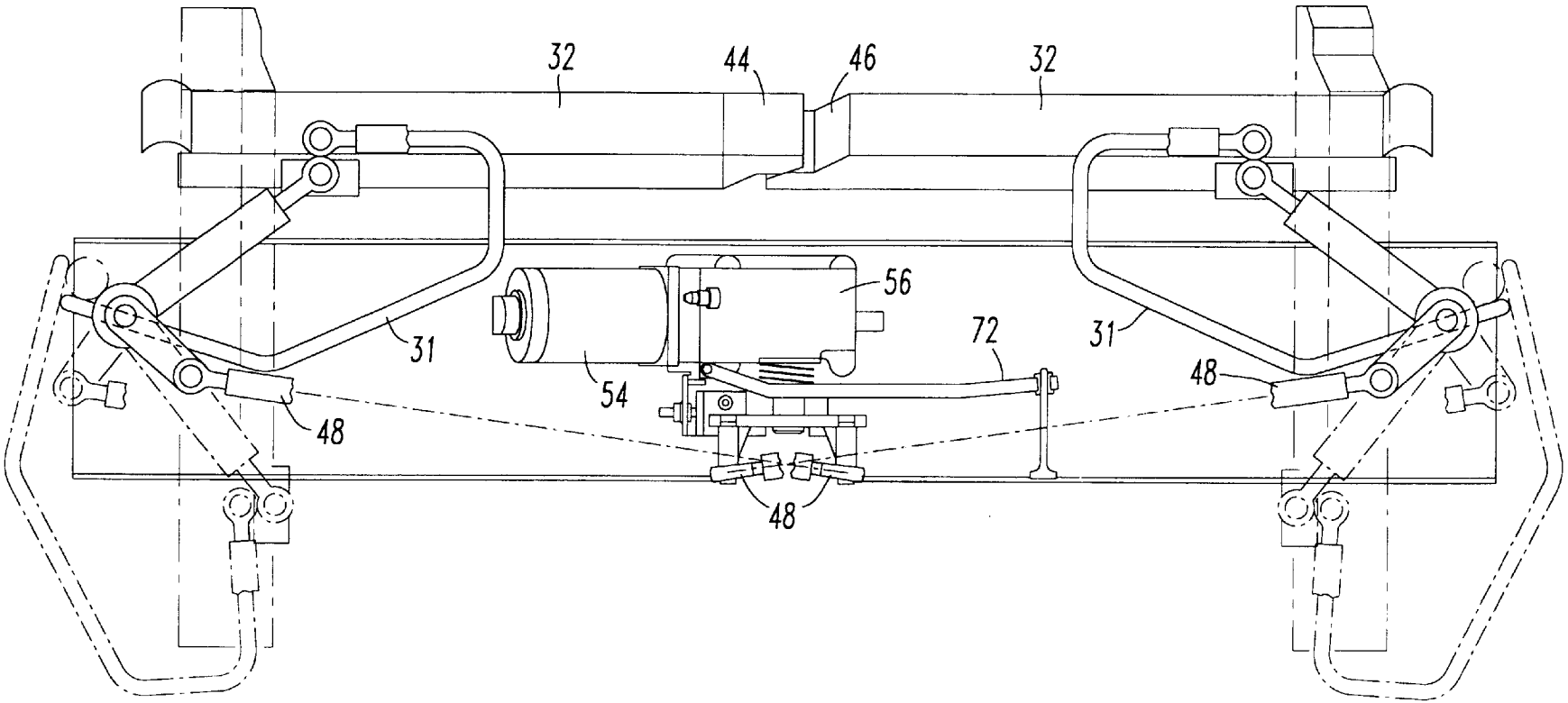
FIG. 9 is a top view of the biparting slide glide passenger transit vehicle door system, illustrated in FIG. 8, according to this invention.

Illustrated in FIGS. 8 and 9 is a presently preferred biparting slide glide door system, generally designated 30, according to an alternative embodiment of the invention.

The presently preferred operator 50 may be used for various biparting door systems, including the swing door system 10 having biparting swing doors 12 or such slide glide door system 30 having biparting slide glide doors 32. Operator 50 has the base 52 for attachment to the passenger transit vehicle (not shown) and a motive power source 54.

In the presently preferred embodiment, motive power source 54 is an electric motor. In this embodiment of the invention, the operator 50 also includes a transmission 56 connected to the motive power source 54 in order to receive motive power therefrom. The transmission 56 having a transmission output power shaft 58. It is presently preferred that the transmission 56 not be back drivable so that the transmission 56 acts as a lock to prevent inadvertent opening of the doors 12 or doors 32 when they are closed. Either the motive power source 54 or the transmission 56 is attached to the base 52.

Operator 50 includes a teeter plate 60 having a shaft engaging portion 100 for engaging the shaft 58 and the shaft 58 includes a teeter plate engaging portion 110 for engaging the teeter plate 60. In the presently preferred embodiment shown, the teeter plate engaging portion 110 of the shaft 58 includes at least one substantially radially oriented member 82, preferably a shaft.

Also, it is presently preferred that the shaft engaging portion 100 of the teeter plate 60 include a central opening 78 and two slots 80 which are oriented substantially radially. Slots 80 are for receiving the radially oriented member(s) 82 to provide a rotary connection between teeter plate 60 and shaft 58. Teeter plate 60 slides on the shaft 58 to engage and disengage radially oriented member(s) 82 with slot 80.

A thrust bearing 66 is in mechanical contact with a hub portion 68 of the teeter plate 60 and a spring 70 is in mechanical contact with the thrust bearing 66 to exert a first axial thrust on thrust bearing 66. The thrust bearing 66 communicates the first axial thrust to the teeter plate 60 so that the shaft engaging portion 100 of the teeter plate 60 engages the teeter plate engaging portion 110 of the shaft 58. It is presently preferred that the hub portion 68 of such teeter plate 60 have an annular recess 67 for receiving such thrust bearing 66. Preferably, the spring 70 is a coil spring disposed concentric with the shaft 58 and with the shaft 58 disposed inside the spring 70.

The operator 50 includes a release member 72 disposed in mechanical contact with the hub portion 68 of the teeter plate 60 for exerting a second axial thrust on the teeter plate 60. Such second axial thrust being opposed to the first axial thrust so that the teeter plate 60 may be disengaged from the shaft 58 by such release member 72.

In the presently preferred embodiment, such release member 72 is a lever pivoted at release lever pivot 84 and includes a teeter plate engaging portion 85. Hub portion 68 has a release lever engaging portion 86 which preferably is a circumferential groove formed in hub portion 68. It is also preferred that such release member 72 have a pair of pins 88 for engaging with circumferential groove 86. Additionally, release member 72 preferably has a motion receiving portion 90 which preferably is attached to a plunger 92 having a knob 94 to be manually activated.

When the doors 12 or the doors 32 are closed and held in the closed position by the transmission 56, a person may open these doors by pressing knob 94 to move the plunger 92 to rotate such release member 72 which moves hub portion 68 and hence such teeter plate 60 in order to disengage such teeter plate 60 from shaft 58. When this is done, teeter plate 60 is free to rotate about shaft 58 and the doors 12 or 32 may be opened.

Figure 3:
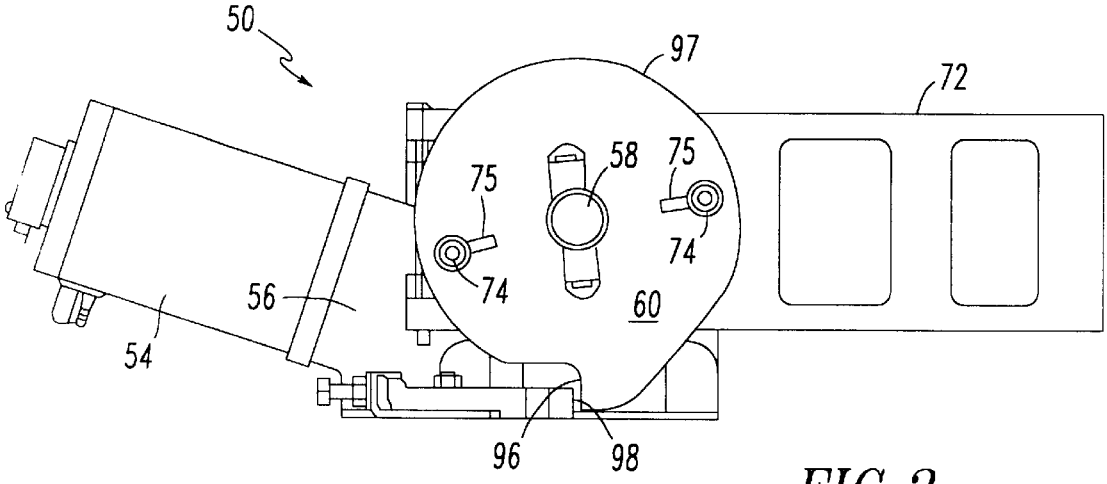
FIG. 3 is a front elevation view of a transit vehicle door actuator according to the present invention.
Figure 4A:
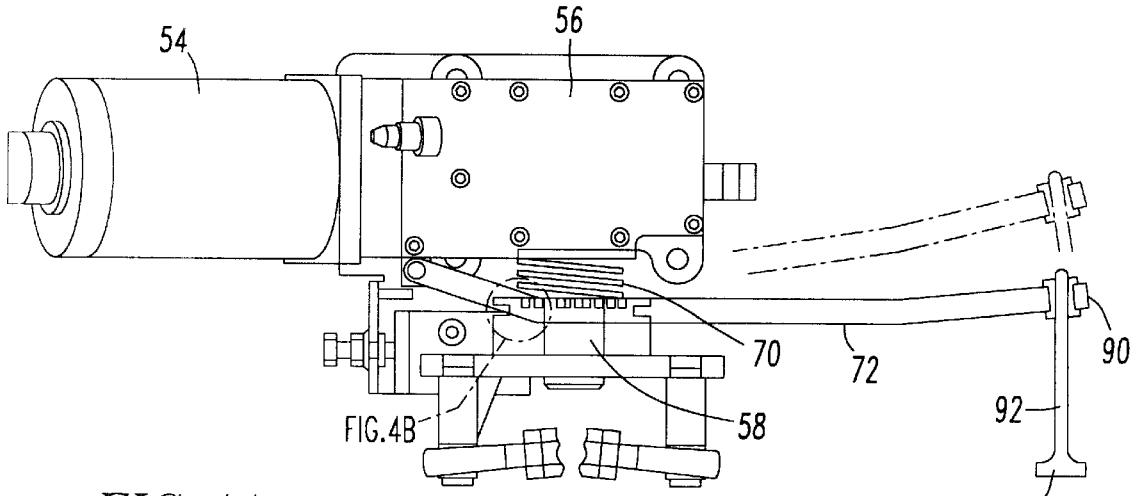
FIG. 4A is a top view of the transit vehicle door actuator, illustrated in FIG. 3, with the release member in normal and release positions.
Figure 4B:
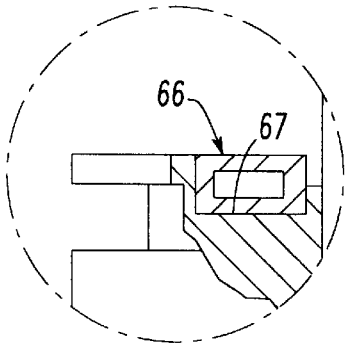
FIG. 4B is a sectional detail of a thrust bearing used to bias the teeter plate into engagement with the output power shaft.
Figure 5A:
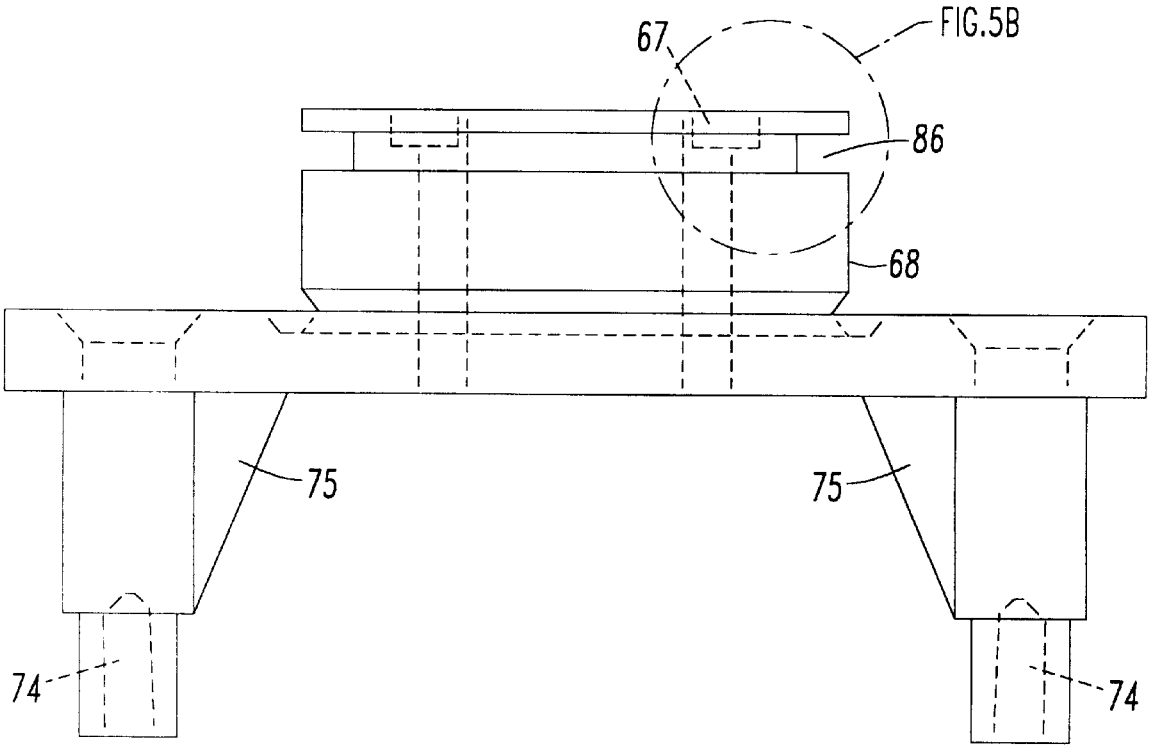
FIG. 5A is a side elevation view of the teeter plate.
Figure 5B:
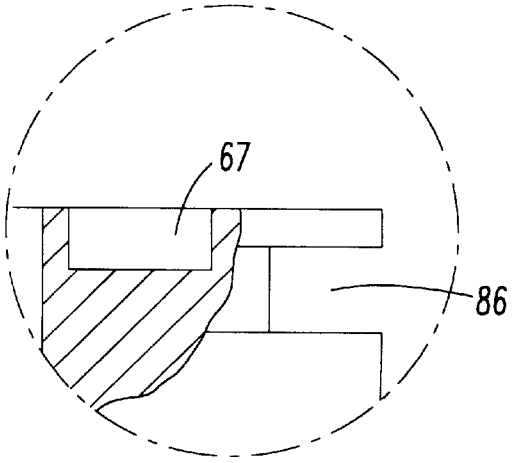
FIG. 5B is a sectional detail of the hub of the teeter plate showing a circumferential groove and a recess for the thrust bearing.

There are a pair of drive rod pivots 74 attached to the teeter plate 60. Such pair of drive rod pivots 74 are connected to a pair of drive rods 24 or 48 for opening and closing the pair of biparting doors 12 or 32. It has been found to be desirable to attach braces 75 to the drive rod pivots 74, as shown in FIGS. 3 and 5A.

It is presently preferred that the teeter plate 60 have a teeter plate stop 96 which provides precise control of the closed positions of doors 12 or 32 and, also, the compression of the door seals 20 and 22 or 44 and 46. If a control system failure permitted the doors to be closed beyond the normal position, by excessive compression of the seals, the door drive pivots 14 or 34 would move to a locked position in which the doors could not be opened.

In the preferred embodiment shown, teeter plate stop 96 is a step in the perimeter 97 of teeter plate 60. Teeter plate stop 96 is for engagement with base stop 98. Preferably, base stop 98 has a position which is adjustable so that the compression of the door seals 20 and 22 or 44 and 46 may be adjusted to a desired level. In the presently preferred embodiment, drive rod pivots 74 are located approximately at diametrically opposed positions as shown, for example, in FIG. 3.

FIGS. 8 and 9 show a slide glide door system 30 according to the invention. Operator 50 has teeter plate 60 which moves drive rods 48 which are connected to door drive pivots 34. Movement of such drive rods 48 causes rotation of the door drive pivots 34 which rotate outer door suspensions 42 which are attached to the doors 32. Doors 32 are also suspended by inner door suspensions 38 which roll in tracks 40. FIG. 9 shows the doors 32 in a closed position in which the door seal 44 engages door seal 46. This figure also shows, in phantom, the doors 32 in the open position. J-arms 31 are also attached to doors 32 to support doors 32. Such J-arms 31 are attached to door pivots 36 and follow conventional practice in the art of slide glide doors.

While a presently preferred and various additional alternative embodiments of the instant invention have been described in detail above in accordance with the patent statutes, it should be recognized that various other modifications and adaptations of the invention may be made by those persons who are skilled in the relevant art without departing from either the spirit of the invention or the scope of the appended claims.

I claim:

1. An operator for a mass transit vehicle door system having a pair of biparting doors, said operator comprising:

(a) a base for attachment to such mass transit vehicle;

(b) a motive power source;

(c) a transmission connected to said motive power source to receive motive power therefrom, said transmission having a transmission output power shaft;

(d) at least one of said motive power source and said transmission being attached to said base;

(e) a teeter plate, said teeter plate including;

(i) a shaft engaging portion for engaging said transmission output power shaft, and (ii) a hub portion;

(f) a thrust bearing in mechanical contact with said hub portion of said teeter plate;

(g) a spring in mechanical contact with said thrust bearing for exerting a first axial thrust thereon, said thrust bearing communicating said first axial thrust to said teeter plate so that said shaft engaging portion of said teeter plate engages said transmission output power shaft;

(h) a release member having mechanical contact with said hub portion of said teeter plate for exerting a second axial thrust on said teeter plate, said second axial thrust being opposed to said first axial thrust so that said teeter plate may be disengaged from said transmission output power shaft by said release member; and (i) a pair of drive rod pivots attached to said teeter plate and connected to a pair of drive rods for opening and closing such pair of biparting doors.

2. An operator, according to claim 1, wherein said teeter plate shaft engaging portion of said teeter plate includes a central opening for fitting over said transmission output power shaft.

3. An operator, according to claim 2, wherein said teeter plate shaft engaging portion further includes at least one radial slot communicating with said central opening.

4. An operator, according to claim 3, wherein a teeter plate engaging portion of said transmission output power shaft includes at least one radially disposed member attached to said transmission output power shaft.

5. An operator, according to claim 3, wherein said at least one radial slot is two diametrically opposed radial slots and a teeter plate engaging portion of said transmission output power shaft includes two diametrically opposed radially disposed members attached to said transmission output power shaft.

6. An operator, according to claim 4, wherein said at least one radially disposed member is a rod having an axis disposed substantially parallel to a radius of said transmission output power shaft.

7. An operator, according to claim 1, wherein said release member is a release lever having each of a release lever pivot attached to said transmission and a teeter plate engaging portion for engaging said hub portion of said teeter plate.

8. An operator, according to claim 7, wherein said teeter plate has a circumferential groove in said hub portion of said teeter plate for engaging said teeter plate engaging portion of said release lever.

9. An operator, according to claim 8, wherein said teeter plate engaging portion of said release lever includes a pair of pins for engaging said circumferential groove.

10. An operator, according to claim 7, wherein said release lever further includes a motion receiving portion for moving said release lever.

11. An operator, according to claim 10, wherein said teeter plate engaging portion of said release lever is disposed between said release lever pivot and said motion receiving portion of said release lever.

12. An operator, according to claim 11, wherein said operator further includes a plunger for engaging said motion receiving portion of said release lever, said plunger being operative to disengage said teeter plate from said transmission output power shaft.

13. An operator, according to claim 12, wherein said plunger further includes a knob, said plunger capable of being manually activated by said knob.

14. An operator, according to claim 1, wherein said teeter plate includes a teeter plate stop for limiting rotation of said teeter plate when such doors are closed, said teeter plate stop contacting a base stop attached to said base when such doors are closed.

15. An operator, according to claim 14, wherein said base stop includes a means for making a position of said base stop adjustable.

16. An operator, according to claim 14, wherein said teeter plate stop is at least one step disposed in a perimeter of said teeter plate.

17. An operator, according to claim 1, wherein said pair of drive rod pivots are located approximately at diametrically opposed positions.

18. A biparting swing door system for a mass transit vehicle, said biparting swing door system comprising:

(a) an operator including a base for attachment to such mass transit vehicle, a motive power source, a transmission connected to said motive power source to receive motive power therefrom, said transmission having a transmission output power shaft, at least one of said motive power source and said transmission being attached to said base, a teeter plate having a shaft engaging portion for engaging said transmission output power shaft, a thrust bearing in mechanical contact with said teeter plate, a spring in mechanical contact with said thrust bearing to exert a first axial thrust thereon, said thrust bearing communicating said first axial thrust to said teeter plate so that said shaft engaging portion of said teeter plate engages a teeter plate engaging portion of said transmission output power shaft, and a release member having mechanical contact with said teeter plate for exerting a second axial thrust on said teeter plate, said second axial thrust being opposed to said first axial thrust so that said teeter plate may be disengaged from said transmission output power shaft by said release member;

(b) two door drive rods connected to a pair of drive rod pivots on said teeter plate; and (c) a pair of biparting swing doors, said door drive rods being connected to said door drive pivots and having mechanical connection to said biparting swing doors to move said biparting swing doors between open and closed positions.

19. A biparting slide glide door system for a mass transit vehicle, said biparting slide glide door system comprising:

(a) an operator having a base for attachment to such mass transit vehicle, a motive power source, a transmission connected to said motive power source to receive motive power therefrom, said transmission having a transmission output power shaft, at least one of said motive power source and said transmission being attached to said base, a teeter plate having a shaft engaging portion for engaging said transmission output power shaft, a thrust bearing in mechanical contact with said teeter plate, a spring in mechanical contact with said thrust bearing to exert a first axial thrust thereon, said thrust bearing communicating said first axial thrust to said teeter plate so that said shaft engaging portion of said teeter plate engages a teeter plate engaging portion of said transmission output power shaft, and a release member having mechanical contact with said teeter plate for exerting a second axial thrust on said teeter plate, said second axial thrust being opposed to said first axial thrust so that said teeter plate may be disengaged from said transmission output power shaft by said release member;

(b) two door drive rods connected to a pair of drive rod pivots on said teeter plate; and (c) a pair of slide glide doors, said door drive rods being connected to said pair of said door drive pivots having mechanical connection to said biparting slide glide doors to move said biparting slide glide doors between open and closed positions.

* * * * *